US005403094A

United States Patent [19]

Tomic

[11] Patent Number: 5,403,094

[45] Date of Patent: Apr. 4, 1995

[54] RECLOSABLE ZIPPER

[75] Inventor: Misdomir Tomic, Appleton, Wis.

[73] Assignee: Reynolds Consumer Products, Inc., Appleton, Wis.

[21] Appl. No.: 132,265

[22] Filed: Oct. 6, 1993

[51] Int. Cl.[6] ..... B65D 33/16

[52] U.S. Cl. ..... 383/63; 383/65; 24/587

[58] Field of Search ..... 383/63, 64, 65; 24/587, 24/576, 400, 399

[56] References Cited

U.S. PATENT DOCUMENTS

| | | | |
|---|---|---|---|
| 3,557,413 | 1/1971 | Engle | 24/576 |
| 4,212,337 | 7/1980 | Kamp | 383/63 |
| 4,658,433 | 4/1987 | Savicki . | |
| 4,778,282 | 10/1988 | Borchardt et al. . | |
| 4,854,017 | 8/1989 | Kamp . | |
| 4,863,286 | 9/1989 | Branson . | |
| 4,907,321 | 3/1990 | Williams . | |
| 5,056,933 | 10/1991 | Kamp . | |
| 5,070,584 | 12/1991 | Dais et al. | 24/400 X |
| 5,140,727 | 8/1992 | Dais et al. | 24/400 X |

FOREIGN PATENT DOCUMENTS

| | | | |
|---|---|---|---|
| 0510797 | 10/1992 | European Pat. Off. | 24/399 |
| 1036544 | 9/1953 | France | 24/399 |
| 1202080 | 1/1960 | France | 24/576 |
| 2639617 | 6/1990 | France . | |
| 2037704 | 7/1980 | United Kingdom . | |
| 2129770 | 5/1984 | United Kingdom . | |

OTHER PUBLICATIONS

Physical Sample of Ziploc ® Brand Gripper ® Zipper Storage Bag, Dow Chemical Co., DowBrands L.P., Indianapolis, Ind. no date.

*Primary Examiner*—Allan N. Shoap
*Assistant Examiner*—Jes F. Pascua
*Attorney, Agent, or Firm*—Alan T. McDonald

[57] ABSTRACT

A reclosable zipper for a reclosable bag comprises a first closure having a first base, a first pair of locking members integrally connected to the first base, and a center guide post integrally connected to the first base. The center guide post is positioned adjacent to and between the first pair of locking members. The zipper further comprises a second closure having a second base, a second pair of locking members integrally connected to the second base, and a pair of outer guide posts integrally connected to the second base. The second pair of locking members are positioned adjacent to and between the pair of outer guide posts. The second closure is disposed adjacent and opposite to the first closure, and the second closure is constructed and arranged to interlock with the first closure over a predetermined length by engagement of the second pair of locking members with the first pair of locking members. The second pair of locking members and the pair of outer guide posts have transverse notches formed therein at intermittent locations along the predetermined length. The notches enhance the ease of locking the zipper and provide positive tactile feedback indicative of effective locking of the zipper.

17 Claims, 3 Drawing Sheets

RECLOSABLE ZIPPER

FIELD OF THE INVENTION

The present invention generally relates to reclosable zippers and, more particularly, is concerned with a reclosable zipper having transverse notches in either the male or female closure.

DESCRIPTION OF THE PRIOR ART

Many consumer packaging applications employ reclosable bags. These bags employ reclosable zippers for locking products within the bags. A typical reclosable zipper includes male and female closures extending along the entire length of the zipper. The female closure is disposed opposite to the male closure and is adapted to mate with the male closure. Each of the closures includes one or more locking members with locking tips. The closures are interlocked by properly aligning the male and female closures and pressing the closures together along the entire length of the zipper so that the locking tips engage with one another.

In some applications, it is preferable to increase the "holding" or "lock" strength of the reclosable zipper to insure that the zipper will not accidently reopen, releasing the contents of the bag. To increase lock strength, existing reclosable zippers employ stiffer materials or different configurations for designing the locking members of the zipper closures. Stiffer materials increase lock strength because such materials do not "give" as easily as more flexible materials, thereby making it more difficult to disengage interlocked locking members. Similarly, locking members may be configured to provide a stronger engagement between mated locking members.

A drawback of existing reclosable zippers is that by increasing lock strength, the ability to lock and relock the zipper is made more difficult. This makes the reclosable zipper less consumer friendly. Another drawback of existing reclosable zippers is that, in addition to a physical check of the zipper, a person generally must make a visual inspection of the zipper following engagement of the closures for assurance of effective locking of the zipper. Consequently, a need exists for a reclosable zipper which overcomes the foregoing drawbacks associated with existing reclosable zippers.

SUMMARY OF THE INVENTION

A reclosable zipper comprises a pair of closures disposed adjacent and opposite to one another. The closures are configured to interlock with one another over a predetermined length, and at least one of the closures is provided with intermittent transverse notches to enhance the ease of interlocking the closures.

BRIEF DESCRIPTION OF THE DRAWINGS

Other objects and advantages of the invention will become apparent upon reading the following detailed description and upon reference to the drawings in which.

Figure 1:
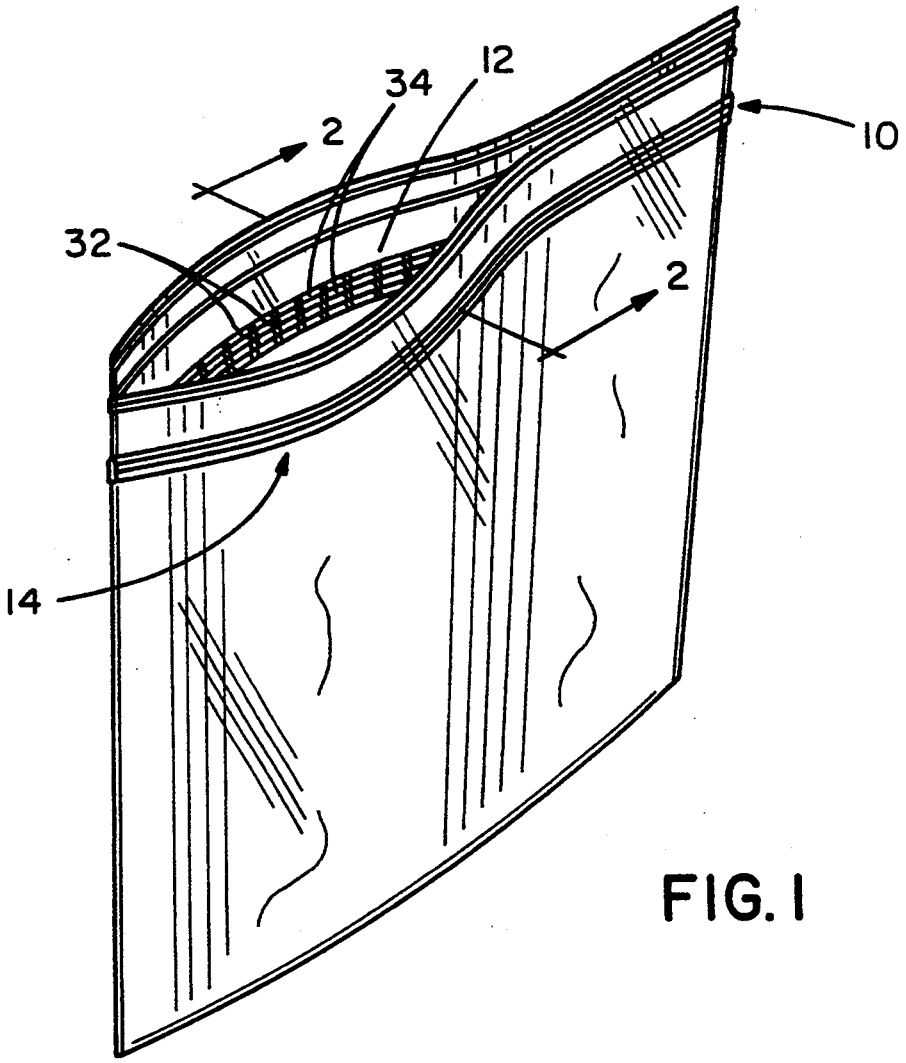
FIG. 1 is a perspective view of a reclosable bag including a reclosable zipper embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 2:
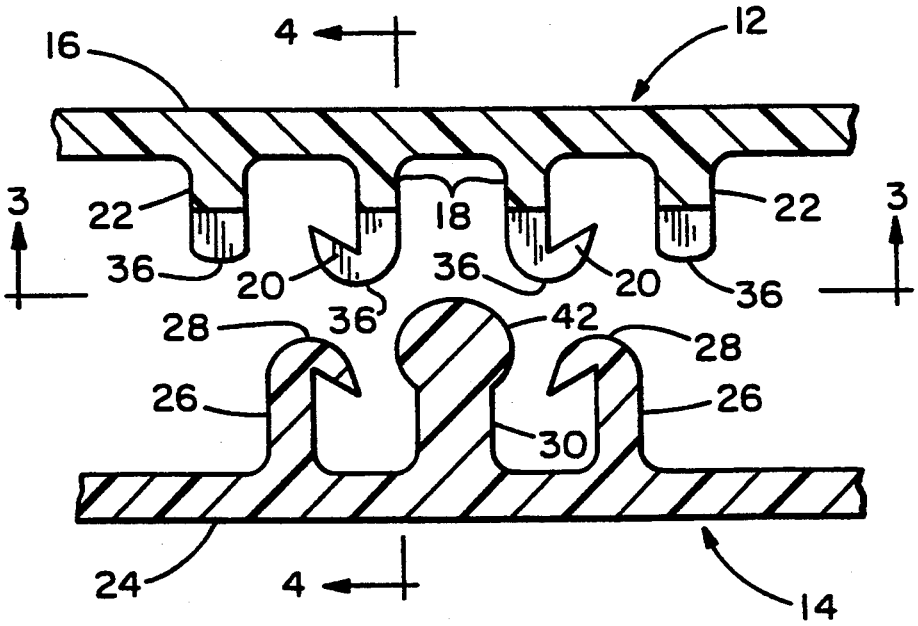
FIG. 2 is a section taken generally along the line 2—2 of FIG. 1.

Turning now to the drawings, FIGS. 1 and 2 illustrate a reclosable zipper 10 having a four-member female closure 12 and a three-member male closure 14. The female and male closures 12, 14 are configured to interlock with one another. In accordance with an important aspect of the present invention, the female closure 12 is provided with transverse notches 32 which divide the female closure 12 into longitudinal segments 34.

In the preferred embodiment, the female closure 12 extends for the length of the zipper 10 and includes a base 16, a pair of locking members 18 with locking tips 20, and a pair of outer guide posts 22. The locking members 18 and guide posts 22 are integrally connected to the base 16 and extend orthogonally therefrom toward the male closure 14. Similarly, the male closure 14 extends for the length of the zipper 10 and includes a base 24, a pair of locking members 26 with locking tips 28, and a center guide post 30. The locking members 26 and guide post 30 are integrally connected to the base 24 and extend orthogonally therefrom toward the female closure 12. While the present invention will be described with reference to the closures 12, 14, it is contemplated that various other closure designs fall within the scope of the present invention.

Figure 5:
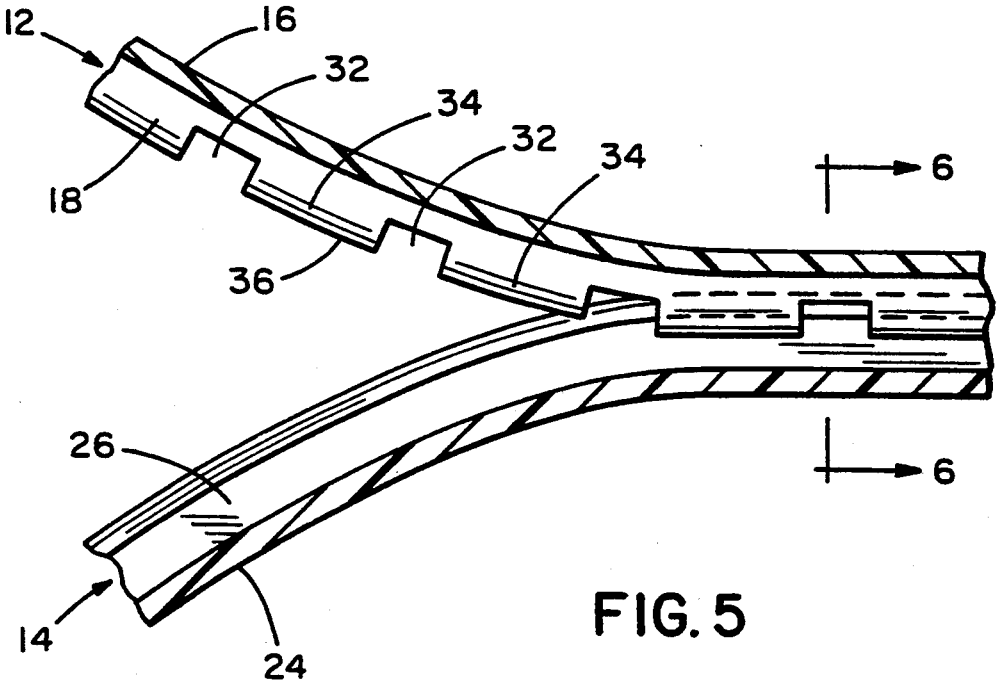
FIG. 5 is a longitudinal side view of locking members of the reclosable zipper partially interlocked to one another.
Figure 6:
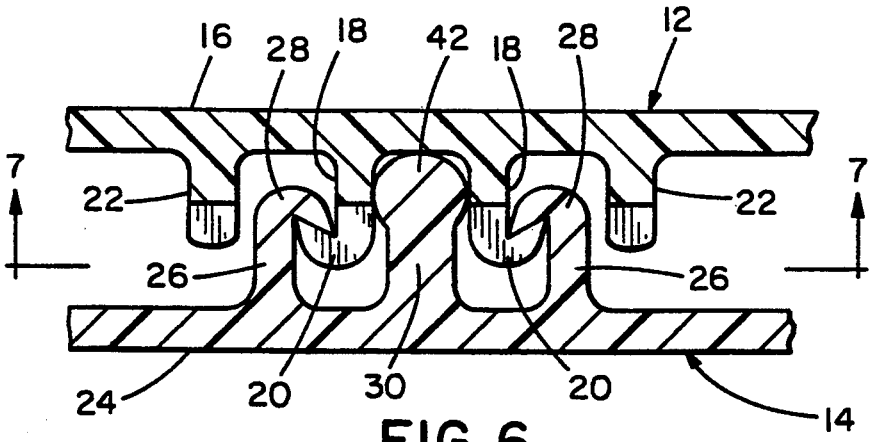
FIG. 6 is a section taken generally along the line 6—6 of FIG. 5.

In order to properly interlock with one another, the female and male closures 12, 14 are positioned adjacent and opposite to one another (FIG. 5). With the closures 12, 14 transversely aligned relative to one another, the closures 12, 14 are pressed against one another (FIGS. 1 and 5). The pressure causes the locking tips 20 of the female closure locking members 18 to "snap" over and engage with the locking tips 28 of the male closure locking members 26. The guide posts 22 guide the locking members 26 between the locking members 18 and the guide posts 22, while the guide post 30 guides the locking members 18 between the locking members 28 and the guide post 30. FIG. 6 illustrates the reclosable zipper with the female and male closures 12, 14 interlocked with one another.

The locking members 18, 26 and the guide posts 22, 30 are constructed and arranged to permit a secure engagement between the female and male closures 12, 14. In particular, the transverse distance between the female closure locking members 18 is slightly greater than the width of the guide post 30 so that when the closures 12, 14 are interlocked, the locking members 18 snugly receive the guide post 30 therebetween. The transverse distance the female closure locking members 18 and the guide posts 22 is slightly greater than the width of the male closure locking members 28 so that the locking members 18 and the guide posts 22 snugly receive the locking members 28 therebetween. Similarly, the transverse distance between the male closure locking members 28 and the guide post 30 is slightly greater than the width of the female closure locking members 18 so that the locking members 28 and the guide post 30 snugly receive the locking members 18 therebetween.

Figure 3:
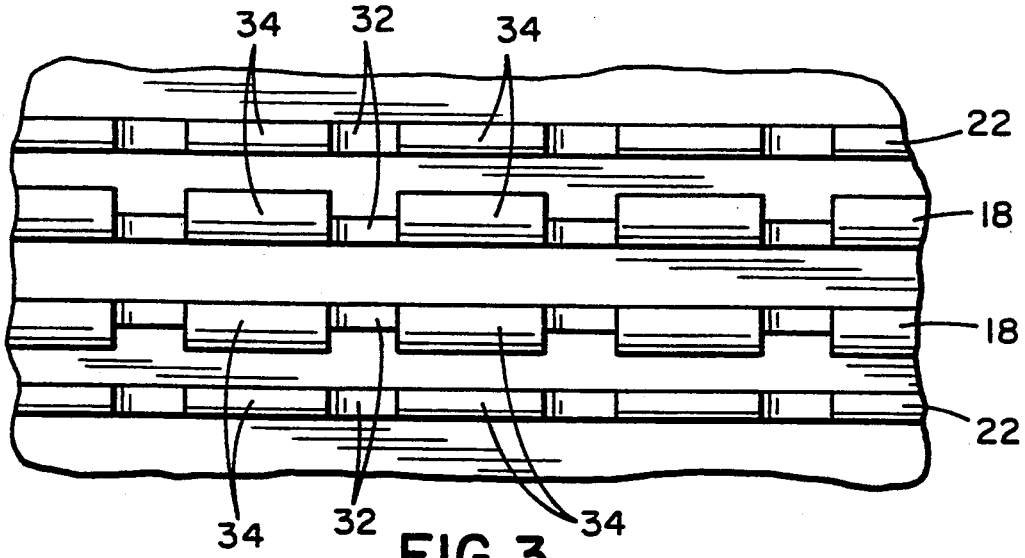
FIG. 3 is a section taken generally along the line 3—3 of FIG. 2.
Figure 4:
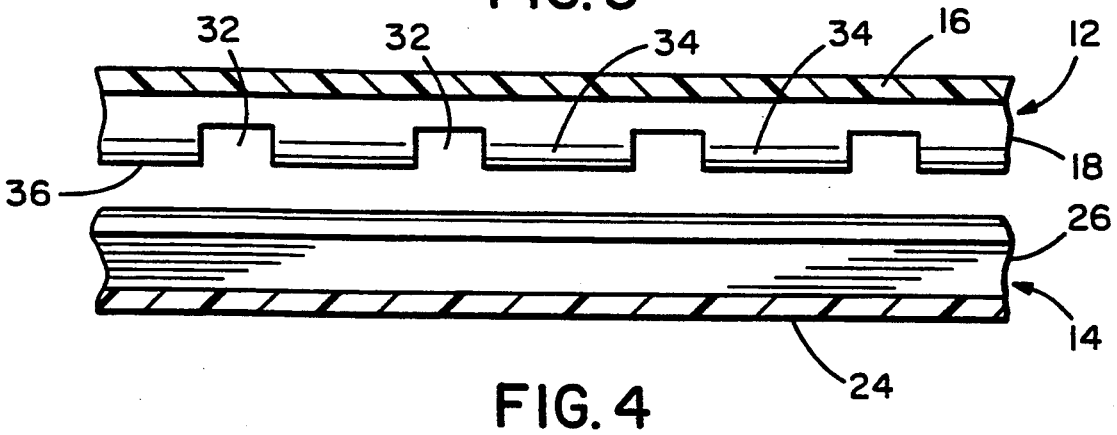
FIG. 4 is a section taken generally along the line 4—4 of FIG. 2.
Figure 7:
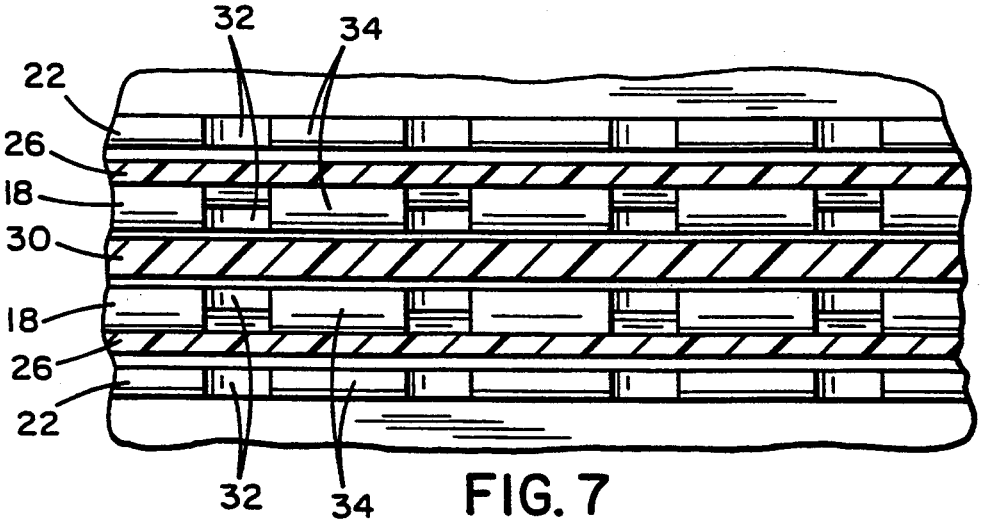
FIG. 7 is a section taken generally along the line 7—7 of FIG. 6.

Referring to FIGS. 3, 4, and 7, the female closure 12 is provided with the transverse notches 32 across the locking members 18 and the outer guide posts 22 so as to divide the female closure 12 into the segments 34. In the preferred embodiment, the notches 32 are spaced at regular intervals and the longitudinal distance between the notches 32 (i.e., the length of the segments 34) is anywhere from 0.0625 inches to 0.75 inches.

Figure 10:
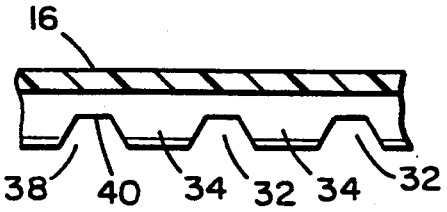
FIG. 10 is a longitudinal side view of a closure member provided with trapezoidal notches.

The depth of the notches 32 is shown by the unhatched portion of the locking members 18 and the guide posts 22 in FIGS. 2 and 6. The notches 32 extend from the top ends 36 of the locking members 18 and the guide posts 22 (i.e., the ends spaced from the base 16) to a depth spaced slightly away from the base 16 (FIGS. 2, 4, 5, and 6). FIG. 10 depicts a generally trapezoidal configuration for the notches 32 in each member of the four-member female closure 12, where the top end of the closure member is represented by the reference number 36. Both the locking member 18 and the guide posts 22 have the trapezoidal notches 32, and FIG. 10 is representative of the generally trapezoidal configuration for any of these closure members. However, since the locking members 18 are smaller in depth than the guide posts 22, it should be understood that the trapezoidal notches in the locking members 18 will be slightly different from the trapezoidal notches in the guide posts 22. For example, the notches in the locking members 18 will have less depth than the notches in the guide posts 22.

Figure 11:
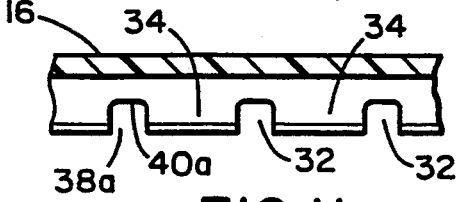
FIG. 11 is a longitudinal side view of a closure member provided with rectangular notches.

It can be seen from FIG. 10 that the notches 32 stop short of the base 16 of the closure 12. Furthermore, the tops 38 of the notches 32 are wider than the bottoms 40 of the notches 32. The notches 32 are preferably narrow relative to the length of the segments 34 between the notches 32, the notches 32 being approximately 0.03125 inches wide at the tops 38 and somewhat less wide at the bottoms 40. Alternatively, as shown in FIG. 11, the notches 32 may be constructed with vertical sides to form a rectangular configuration so that their tops **38*a* have the same width as their bottoms 40*a*. The notches 32 are preferably imparted to the female closure 12 using a variety of cutting techniques, including saws, blades, or water jets. Alternatively, the notches 32 may be formed by extruding the female closure 12 with segments 34**.

The notches 32 enhance the ease of locking the reclosable zipper 10 by facilitating engagement of the female closure locking members 20 with the male closure locking members 26. More specifically, shorter segments between the notches 32 have more "give" in the transverse direction than longer segments. It follows that since shorter segments are more easily deflected in the transverse direction than longer segments, the segments 34 deflect more easily than an unsegmented zipper. Due to the ease of locking the zipper 10, a user generally needs to run his or her hands over the zipper 10 relatively few times compared to typical unsegmented zippers to achieve a locked zipper 10.

To promote the ease of locking the zipper 10, the notches 32 extend entirely through the locking members 18 and the outer guide posts 22 in the transverse direction. Such a complete transverse notch is different from a situation in which one or more grooves are formed in the sides of a locking member, thereby leaving the top end of the locking member intact. Although this latter situation may improve tactile feedback indicative of effective closure, it fails to promote easier locking because the side grooves do not divide the locking member into easily deflectable segments. On the contrary, the zipper 10 embodying the present invention contains the notches 32 which partition the locking members 18 and the guide posts 22 into the clearly definable and easily deflectable segments 34.

The notches 32 also enable a user to "feel" when the closures 12, 14 are interlocked so that the user need not visually inspect the zipper 10 for assurance of proper closure. That is, the notches 32 provide positive tactile feedback indicative of effective locking of the zipper 10. This tactile feedback results from feeling the zipper 10 lock segment by segment, as opposed to feeling one continuous, unsegmented zipper. In addition, the notches 32 enhance the flexibility of the zipper 10 by minimizing the stiffness of the locking members 18 and the guide posts 22 at the locations of the notches 32. The notches 32 reduce the amount of zipper material at the notch locations, thereby enabling the zipper 10 to bend more easily at these locations. A more flexible zipper is advantageous to a user who, for example, wishes to fold a bag containing a relatively small amount of product so that the bag can be stored in a smaller area.

In one embodiment, the guide post 30 on the three-member male closure 14 is designed to minimize liquid leakage through the notches 32 from the contents of the reclosable bag to which the zipper 10 is attached. In particular, the guide post 30 has a depth such that when the closures 12, 14 are interlocked with one another, the guide post 30 contacts or abuts the base 16 of the female closure 12. FIG. 6 depicts the guide post 30 in contact with the base 16. In addition, the guide post 30 is provided with an expanded head 42 which snugly fits into the gap between the locking members 18. This "ball-in-socket" type arrangement minimizes liquid leakage through the zipper 10. In an alternative embodiment, the guide post 30 is designed with a head having the same width as the remainder of the guide post 30 and with a depth equal to or shorter than the depth of the adjacent locking members 26.

Figure 8:
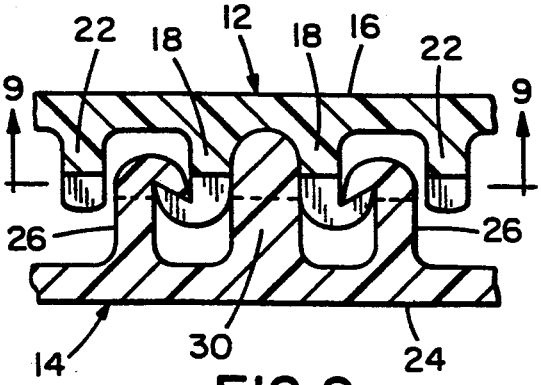
FIG. 8 is a lateral cross-section of the reclosable zipper embodying the present invention with notches provided in both the male and female closures.
Figure 9:
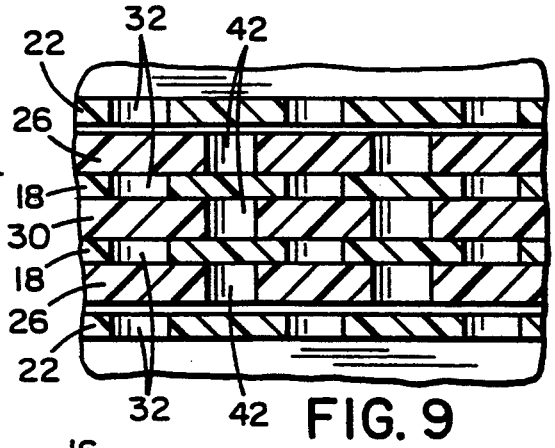
FIG. 9 is a section taken generally along the line 9—9 of FIG. 8.

In an alternative embodiment of the present invention shown in FIGS. 8 and 9, both the female and male closures 12, 14 are provided with respective notches 32, 42 so as to maximize the ease of locking the reclosable zipper. To minimize leakage through the notches 32, 42, the notches 42 are offset or staggered relative to the notches 32. With notches on both the male and female closures 12, 14, leakage is further minimized by modifying the depth of the guide posts 22 on the female closure 12. More specifically, the depths of the guide posts 22 are increased so that they abut the base 24 during closure engagement (not shown). With both the guide posts 22 and the guide post 30 abutting the opposing base, leakage through the zipper 10 is minimized.

While the present invention has been described with reference to one or more particular embodiments, those skilled in the art will recognize that many changes may be made thereto without departing from the spirit and scope of the present invention. For example, the notches 32, 42 may be modified by changing the depth, width, and shape of the notches. Further, an individual notch in one closure member may be constructed with a depth, width, or shape different from other notches in that same closure member or other notches in other closure members. The following claims set forth the scope of the present invention.

What is claimed is:

1. A reclosable zipper comprising:

a pair of closures disposed adjacent and opposite to one another, said pair of closures being configured to interlock with one another over a predetermined length, one of said pair of closures having transverse notches having a top, a bottom, and a pair of sides formed therein at intermittent locations along said predetermined length, said notches dividing said one of said pair of closures into deflectable segments so as to enhance the ease of interlocking said pair of closures, wherein said one of said pair of closures includes a base and a locking member integrally connected to said base and having a tip, and wherein said one of said pair of closures includes a guide post integrally connected to said base, said guide post being positioned adjacent to said locking member, and wherein said notches are formed in said locking member and said guide post at intermittent locations along the length of said locking member and said guide post.

2. The reclosable zipper of claim 1, wherein said notches in said locking member and said notches in said guide post are transversely aligned relative to one another.

3. The reclosable zipper of claim 1, wherein said notches have a trapezoidal shape such that the top of said notches is wider than the bottom of said notches.

4. The reclosable zipper of claim 1, wherein said notches have a generally rectangular shape such that the top of said notches have substantially the same width as the bottom of said notches.

5. The reclosable zipper of claim 1, wherein said notches extend from the tip of said locking member to a depth spaced slightly away from said base.

6. The reclosable zipper of claim 1, wherein said notches are narrow relative to the longitudinal distance between said notches.

7. The reclosable zipper of claim 1, wherein the other of said pair of closures includes transverse notches formed therein at intermittent locations along said predetermined length.

8. The reclosable zipper of claim 7, wherein said notches in said one of said pair of closures are offset relative to said notches in said other of said pair of closures.

9. A reclosable zipper, comprising:

a first closure having a first base, a first pair of locking members integrally connected to said first base and having tips, and a center guide post integrally connected to said first base, said center guide post being positioned adjacent to and between said first pair of locking members; and a second closure having a second base, a second pair of locking members integrally connected to said second base and having tips, and a pair of outer guide posts integrally connected to said second base, said second pair of locking members being positioned adjacent to and between said pair of outer guide posts, said second closure being disposed adjacent and opposite to said first closure, said second closure being constructed and arranged to interlock with said first closure over a predetermined length by engagement of said second pair of locking members with said first pair of locking members, said second pair of locking members and said pair of outer guide posts having transverse notches having a top, a bottom, and a pair of sides formed therein at intermittent locations along said predetermined length.

10. The reclosable zipper of claim 9, wherein said notches in said second pair of locking members and said pair of outer guide posts are transversely aligned relative to one another.

11. The reclosable zipper of claim 9, wherein said notches have a trapezoidal shape such that the top of said notches is wider than the bottom of said notches.

12. The reclosable zipper of claim 9, wherein said notches have a generally rectangular shape such that the top of said notches have substantially the same width as the bottom of said notches.

13. The reclosable zipper of claim 9, wherein said notches extend from the tips of said second pair of locking members and said pair of outer guide posts to a depth spaced slightly away from said second base.

14. The reclosable zipper of claim 9, wherein said notches are narrow relative to the longitudinal distance between said notches.

15. The reclosable zipper of claim 9, wherein said first pair of locking members and said center guide post include transverse notches formed therein at intermittent locations along said predetermined length.

16. The reclosable zipper of claim 15, wherein said notches in said first pair of locking members and said center guide post are offset relative to said notches in said second pair of locking members and said pair of outer guide posts.

17. The reclosable zipper of claim 9, wherein said center guide post abuts said second base when said first and second closures are interlocked with one another.

* * * * *